US006925435B1

(12) United States Patent
Gao

(10) Patent No.: US 6,925,435 B1
(45) Date of Patent: Aug. 2, 2005

(54) METHOD AND APPARATUS FOR IMPROVED NOISE REDUCTION IN A SPEECH ENCODER

(75) Inventor: Yang Gao, Mission Viejo, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 366 days.

(21) Appl. No.: 09/723,616

(22) Filed: Nov. 27, 2000

(51) Int. Cl.[7] ..... G10L 19/00
(52) U.S. Cl. ..... 704/220; 704/226; 704/219
(58) Field of Search ..... 704/201, 203, 704/204, 205, 206, 207, 208, 209, 216–221, 223–228, 233, 234, 261–266

(56) References Cited

U.S. PATENT DOCUMENTS

| | | | | | |
|---|---|---|---|---|---|
| 5,884,253 | A | * | 3/1999 | Kleijn | 704/223 |
| 5,915,234 | A | * | 6/1999 | Itoh | 704/219 |
| 6,088,668 | A | | 7/2000 | Zack | |
| 6,097,820 | A | * | 8/2000 | Turner | 381/94.3 |
| 6,233,550 | B1 | * | 5/2001 | Gersho et al. | 704/208 |
| 6,366,880 | B1 | * | 4/2002 | Ashley | 704/226 |
| 6,466,904 | B1 | * | 10/2002 | Gao et al. | 704/220 |

FOREIGN PATENT DOCUMENTS

EP 0556992 A 8/1993

OTHER PUBLICATIONS

W. Bastiaan Kleijn; Encoding Speech Using Prototype Waveforms; IEEE Transactions on Speech and Audio Processing, Vol. 1 No. 4, Oct. 1993, pp. 386–399.*
PCT International Search Report.*
Bhaskar U et al: "Design and performance of a 4.0 kbit/s speech coder based on frequency–domain interpolation" 2000 IEEE Workshop on Speech Coding. Proceedings. Meeting the Challenges of the New Millennium (Cat. No. 00EX421), 2000 IEEE Workshop on Speech Coding. Proceedings. Meeting the Challenges of the New Millennium, Delavan, WI, USA, Sep. 17–20, 2000, pp. 8–10, XP002201858 2000, Piscataway, NJ, USA, IEEE, USA ISBN: 0–7803–6416–3 chapter 2.1 abstract; figure 1.
Chong N R et al: "The effects of noise on the waveform interpolation speech coder" TENCON '97. IEEE Region 10 Annual Conference. Speech and Image Technologies for Computing and Telecommunications., Proceedings of IEEE Brisbane, QLD., Australia Dec. 2–4, 1997, New York, NY, USA, IEEE, US, Dec. 2, 1997, pp. 609–612, XP010264318 ISBN: 0–7803–4365–4 the whole document.

* cited by examiner

*Primary Examiner*—Abul K. Azad
(74) *Attorney, Agent, or Firm*—Farjami & Farjami LLP

(57) ABSTRACT

A speech encoder comprises an encoding element for encoding a noise reduced speech signal, and a noise suppression element that takes a noisy speech signal and generates the noise reduced speech signal by maximizing the signal to noise ratio (SNR) of the noisy speech signal without suppressing the voiced speech components of the noisy speech signal. The noise suppression element may use harmonic modeling techniques that maximize the SNR in each sub-band of the noisy speech signal by reconstructing the voiced speech components of the noisy voiced speech signal emphasizing harmonic frequencies within each sub-band. The SNR is further maximized by eliminating noise components between signal peaks at the harmonic frequencies, and eliminating noise at signal peaks at the harmonic frequencies by smoothing harmonic parameters generated by the reconstruction of the voiced speech components of the noisy speech signal.

20 Claims, 10 Drawing Sheets

METHOD AND APPARATUS FOR IMPROVED NOISE REDUCTION IN A SPEECH ENCODER

FIELD OF THE INVENTION

The present invention relates generally to speech coding systems, and more particularly, to a method and apparatus for improved noise reduction in a speech encoder.

BACKGROUND OF THE INVENTION

In speech coding systems, reducing background noise in speech signals to improve the quality of processed speech is a primary endeavor. This fact is particularly true for lower signal to background noise ratios A typical speech coding system comprises an encoder, a transmission channel, and a decoder. Parameters for synthesizing speech signals are transmitted from the encoder over the transmission channel to the decoder. The decoder then uses the parameters to synthesize the desired speech signal.

In wireless communications systems, the most common form of speech coders use linear predictive methods. One example linear predictive method is Code Excited Linear Prediction (CELP). A general diagram of a CELP encoder 100 is shown in FIG. 1A. A CELP encoder uses a model of the human vocal tract in order to reproduce a speech input signal. The parameters for the model are actually extracted from the speech signal being reproduced, and it is these parameters that are sent to a decoder 112, which is illustrated in FIG. 1B. Decoder 112 uses the parameters in order to reproduce the speech signal. Referring to FIG. 1A, synthesis filter 104 is a linear predictive filter and serves as the vocal tract model for CELP encoder 100. Synthesis filter 104 takes an input excitation signal $\mu(n)$ and synthesizes an estimate of speech input s(n) by modeling the correlations introduced into speech by the vocal tract and applying them to the excitation signal $\mu(n)$.

In CELP encoder 100 speech is broken up into frames, usually 20 ms each, and parameters for synthesis filter 104 are determined for each frame. Once the parameters are determined, an excitation signal $\mu(n)$ is chosen for that frame. The excitation signal is then synthesized, producing a synthesized speech signal s'(n). The synthesized frame s'(n) is then compared to the actual speech input frame s(n) and a difference or error signal e(n) is generated by subtractor 106. The subtraction function is typically accomplished via an adder or similar functional component as those skilled in the art will be aware. Actually, excitation signal $\mu(n)$ is generated from a predetermined set of possible signals by excitation generator 102. In CELP encoder 100, all possible signals in the predetermined set are tried in order to find the one that produces the smallest error signal e(n). Once this particular excitation signal $\mu(n)$ is found, the signal and the corresponding filter parameters are sent to decoder 112 (FIG. 1B), which reproduces the synthesized speech signal s'(n). Signal s'(n) is reproduced in decoder 112 by using an excitation signal $\mu(n)$, as generated by decoder excitation generator 114, and synthesizing it using decoder synthesis filter 116.

By choosing the excitation signal that produces the smallest error signal e(n), a very good approximation of speech input s(n) can be reproduced in decoder 112. The spectrum of error signal e(n), however, will be very flat, as illustrated by curve 204 in FIG. 2. The flatness can create problems in that the signal-to-noise ratio (SNR), with regard to synthesized speech signal s'(n) (curve 202), may become too small for effective reproduction of speech signal s(n). This problem is especially prevalent in the higher frequencies where, as illustrated in FIG. 2, there is typically less energy in the spectrum of s'(n). In order to combat this problem, CELP encoder 100 includes a feedback path that incorporates error weighting filter 108. The function of error weighting filter 108 is to shape the spectrum of error signal e(n) so that the noise spectrum is concentrated in areas of high voice content. In effect, the shape of the noise spectrum associated with the weighted error signal $e_w(n)$ tracks the spectrum of the synthesized speech signal s'(n), as illustrated in FIG. 2 by curve 206. In this manner, the SNR is improved and the perceptual quality of the reproduced speech is increased.

If, however, speech input s(n) is noisy, then some type of noise reduction must be performed on speech input s(n) to maintain an adequate quality of voice reproduction in decoder 112. Traditional noise suppressors can reduce the background noise significantly, but they also distort the speech signal significantly due to the significant modification of the spectral envelope. As a result, the perceptual naturalness of the voiced speech signal is reduced sometimes significantly. Therefore, the requirement for noise suppression and the requirement for perceptually natural voiced signals make it difficult to effectively achieve both simultaneously.

SUMMARY OF THE INVENTION

There is provided a speech encoder, comprising an encoding element for encoding a noise reduced speech signal, and a noise suppression element that takes a noisy speech signal and generates the noise reduced speech signal by maximizing the signal to noise ratio (SNR) of the noisy speech signal without significantly suppressing the speech components of the noisy speech signal. In one particular embodiment, the noise suppression element uses harmonic modeling techniques that maximizes the SNR in each sub-band of the noisy speech signal by reconstructing the noisy speech signal emphasizing harmonic frequencies within each sub-band. The SNR is further maximized eliminating noise components between harmonic peaks, and eliminating noise at harmonic peaks by smoothing harmonic parameters generated by the reconstruction of the noisy speech.

There is also provided, a speech communication system, comprising a speech encoder, which includes an encoding element for encoding a noise reduced speech signal, and a noise suppression element. The speech communication system also includes a decoder that generates a synthesized noise reduced speech signal, which is an estimate of the noise reduced speech signal, from speech parameters generated by the encoding element, and a transmission channel for transmitting the speech parameters from the speech encoder to the decoder.

There is also provided a method of noise suppression in a speech encoder, comprising the steps of reconstructing a noisy speech signal emphasizing harmonic frequencies within the noisy speech signals, then eliminating noise components between signal peaks at the harmonic frequencies. Next, the method includes the step of eliminating noise components at the harmonic peaks by smoothing harmonic parameters generated by the reconstructing step, and then generating a noise reduced speech signal.

In addition, further embodiments and implementations are discussed in more detail below.

BRIEF DESCRIPTION OF THE DRAWINGS

In the figures of the accompanying drawings, like reference numbers correspond to like elements, in which.

DETAILED DESCRIPTION OF PREFERRED EMBODIMENTS

Figure 1A:
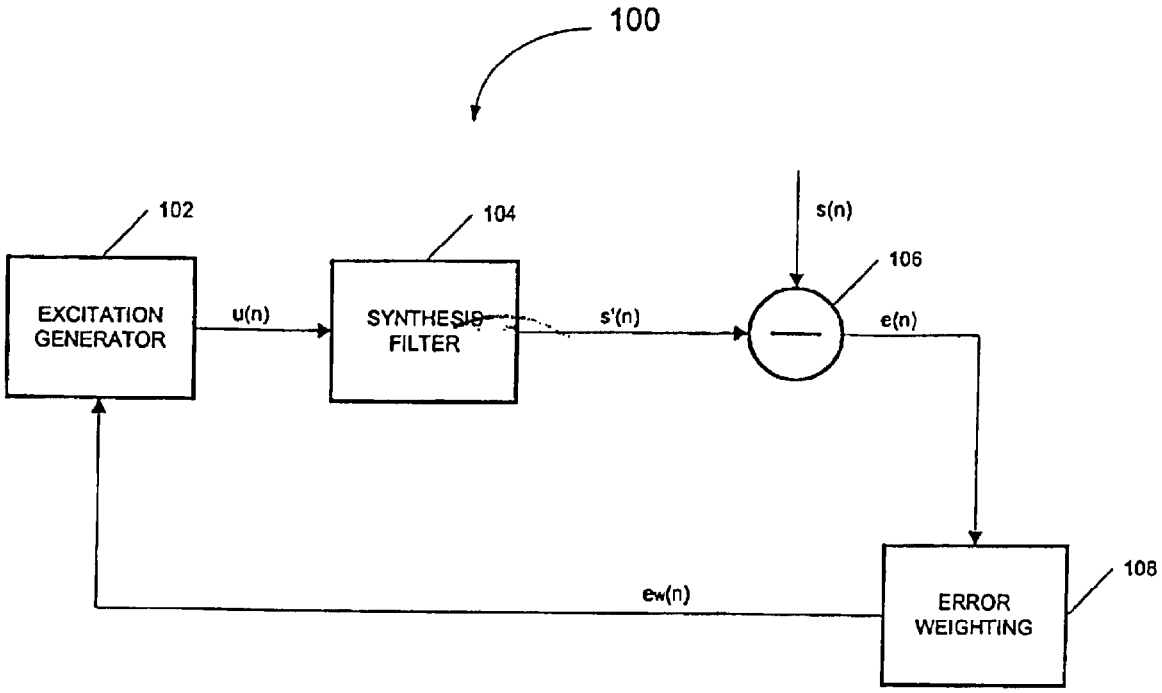
FIGURE 1A (PRIOR ART)
FIG. 1A is a block diagram illustrating an example speech encoder.
Figure 1B:
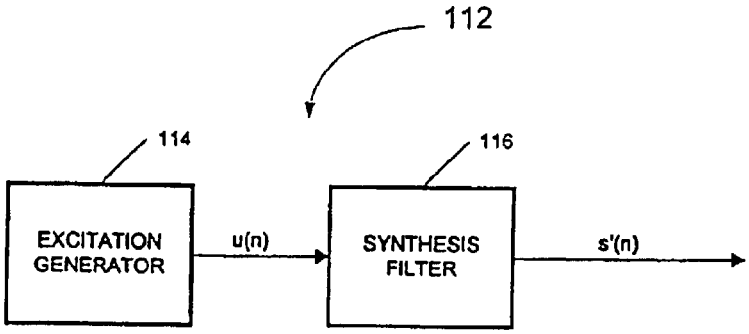
FIGURE 1B (PRIOR ART)
FIG. 1B is a block diagram illustrating an example speech decoder that works in conjunction with the encoder illustrated in FIG. 1A.
Figure 2:
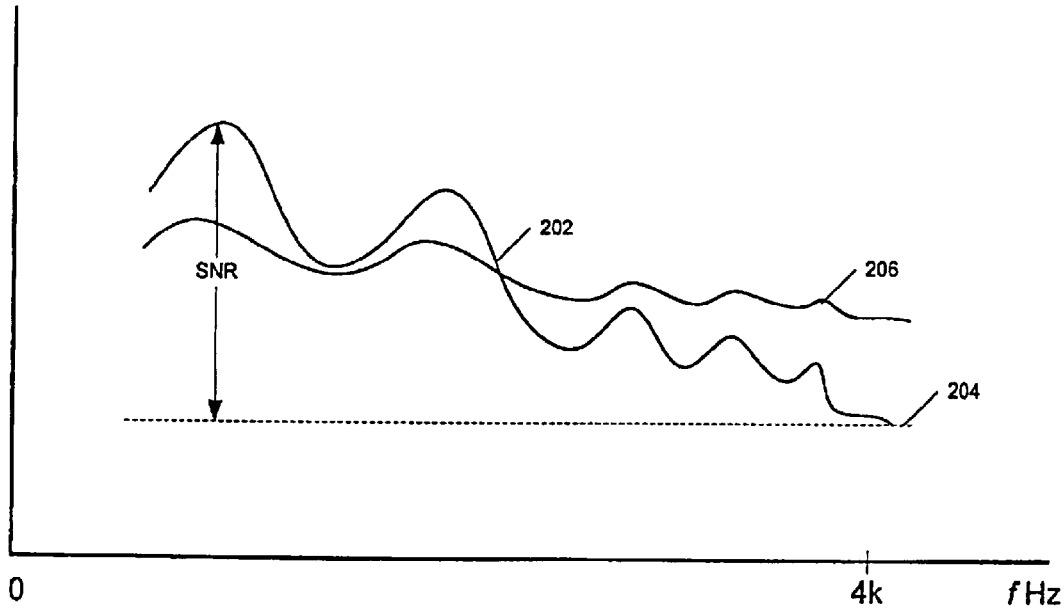
FIGURE 2 (PRIOR ART)
FIG. 2 is a diagram illustrating the signal to noise ratio for a speech signal versus a noise signal in an encoder such as the encoder illustrated in FIG. 1A.
Figure 3:
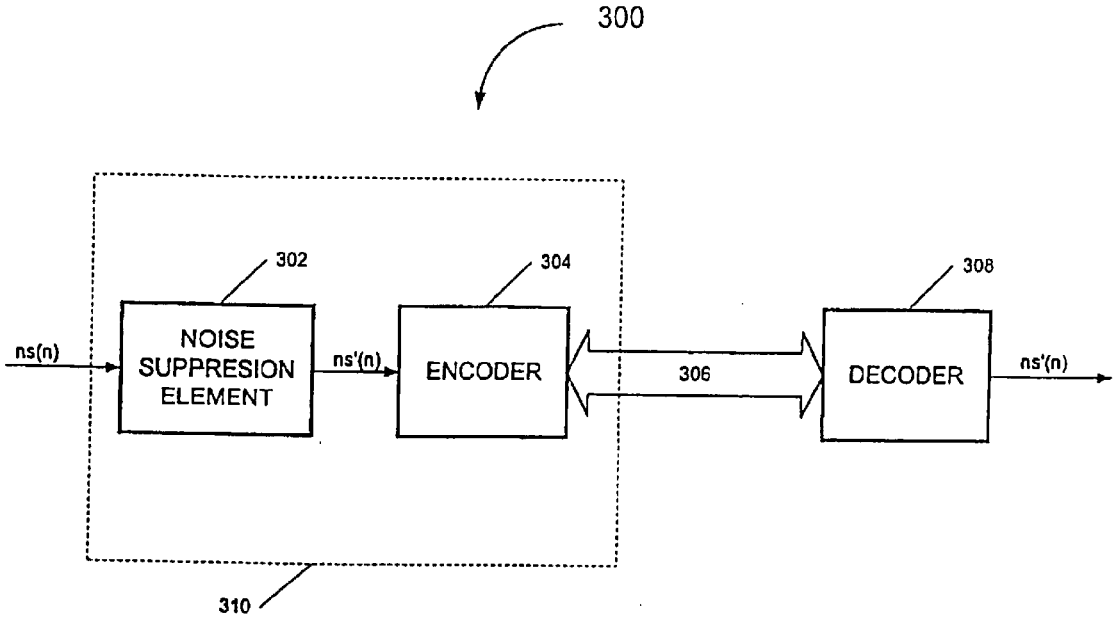
FIG. 3 is a block diagram illustrating a speech communication system in accordance with one embodiment of the invention.

FIG. 3 illustrates a speech coding system 300 in accordance with one embodiment of the invention. Speech coding system 300 comprises a noise suppression element 302, an encoder 304, a transmission channel 306, and a decoder 308. Noise suppression element 302 and encoder 304 form a modified speech encoder 310. Noise suppression element 302 takes a noisy speech signal ns(n) and produces a noise reduced speech signal ns'(n). The noise reduced speech signal ns'(n) is sent to encoder 304, which encodes ns'(n) and transmits encoding parameters to decoder 308 over transmission channel 306. For example, encoder 304 may be a linear predictive encoder, and decoder 308 may be a corresponding linear predictive decoder. In particular, encoder 304 may be a CELP encoder such as that disclosed in co-pending U.S. Application Ser. No. 09/625,088, titled "Method and Apparatus for Improving Weighting Filters in a CELP Encoder," which is incorporated herein by reference in its entirety. Similarly, an example of a CELP decoder that may be used with the invention is disclosed in co-pending U.S. Application Ser. No. 09/624,187, titled "Method and Apparatus for Using Harmonic Modeling in an Improved Speech Decoder," which is also incorporated herein by reference in its entirety.

While the invention will generally be discussed in relation to CELP encoding, those skilled in the art will recognize that there are many types of linear predictive coding (LPC) techniques. For example, other LPC techniques include QCELP, MELP, and HE-LPC, to name a few. As such, those skilled in the art will recognize that any of these alternative LPC techniques may be used without deviating from the scope of the invention. Therefore, CELP is used solely as an example and is not intended to limit the invention in any way.

Figure 4:
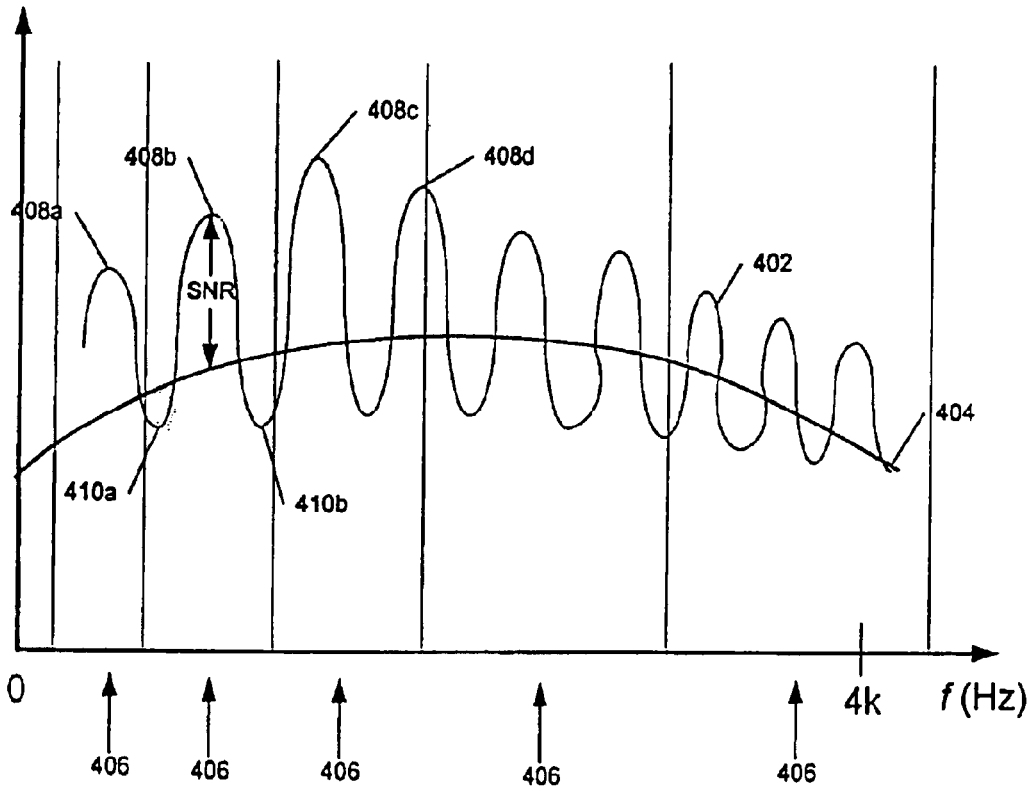
FIG. 4 is a diagram illustrating the signal to noise ratio for a speech signal in the speech communication system illustrated in FIG. 3.

FIG. 4 illustrates a general approach to noise suppression in a speech coding system. Spectrum 402 represents a spectrum for voiced speech, and noise level 404 represents the level of noise present in spectrum 402. Typically, for narrow band signal, spectrum 402 will extend from 0 Hz to 4 KHz. Spectrum 402 is divided into a plurality of sub-bands 406. The number of sub-bands 406 is variable, however, a typical embodiment will employ 20 sub-bands 406. Once the spectrum is divided into sub-bands 406, the SNR for each sub-band 406 is estimated. As can be seen in FIG. 4, sub-bands 406 do not need to be of equal width. In fact, for sub-bands 406 at higher frequencies, it is better to use wider bands 406

After estimating the SNR for each band 406, an attempt is made to improve the over-all SNR by reducing the energy of the noisy channels (sub-bands 406). The gain reduction factor is based on the SNR value of the current channel. Unfortunately, common techniques for noise suppression will distort and suppress speech spectrum 402 as well. This distortion degrades the perceptual naturalness of the voiced speech. In other words, there is some conflict between the noise level reduction and the naturalness. Therefore, while this approach is efficient for unvoiced signals, it is not sufficient for use when spectrum 402 represents a voiced speech signal. In one embodiment, noise suppression element 302 uses the SNR estimating technique when ns(n) is a non-voiced speech signal. But noise suppression element 302 detects when ns(n) represents a voiced speech signal, and uses or combines an alternative method to suppress the noise that does not distort the voice speech spectrum 402 of ns(n). For example, the spectrum can be divided into the harmonic structure area where the new noise suppression technique is used and the non-harmonic area where the traditional noise suppression technique is employed.

Figure 5:
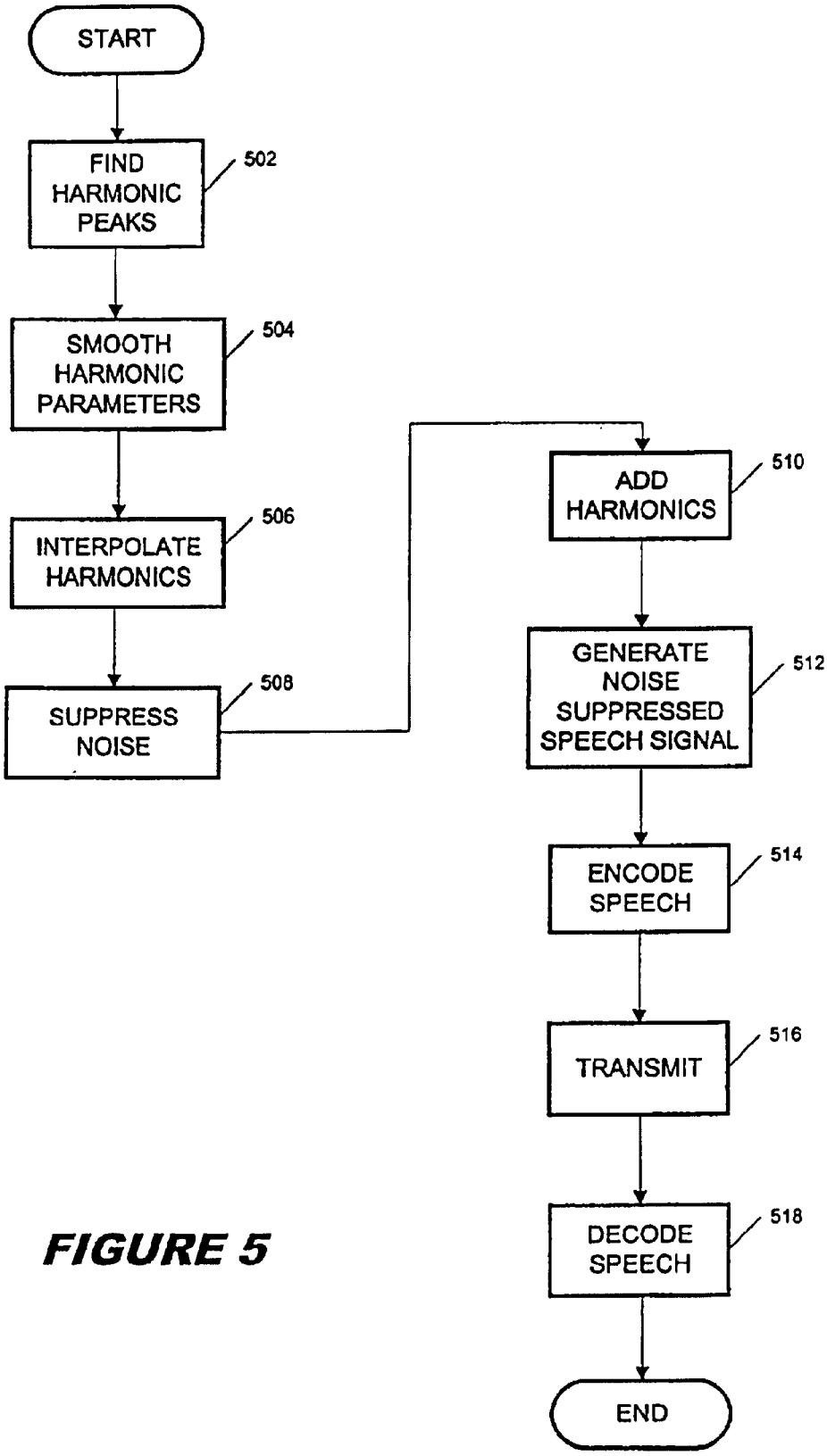
FIG. 5 is a process flow diagram illustrating a method of noise suppression in a speech encoder in accordance with the invention.

The basic alternative method is illustrated in FIG. 5. First, in step 502, noise suppression element 302 finds the harmonic peaks 408 in each sub-band 406 of spectrum 402. For example, in FIG. 4 there are four peaks 408*a*, 408*b*, 408*c*, and 408*d* in the first three sub-bands 406. Magnitude and phase specify a harmonic peak and there will be a plurality of harmonics within each sub-band 406. Then, in step 504, the harmonic parameters associated with the synthesized periodic signal are smoothed. In step 506, the harmonics 408 are interpolated.

The above steps 502–506 represent a process referred to as harmonic modeling. In one sample embodiment, the harmonic modeling is performed using Prototype Waveform Interpolation (PWI). In general, the perceptual importance of the periodicity in voiced speech led to the development of waveform interpolation techniques. PWI exploits the fact that pitch-cycle waveforms in a voiced segment evolve slowly with time. As a result, it is not necessary to know every pitch-cycle to recreate a highly accurate waveform. The pitch-cycle waveforms that are not known are then derived by means of interpolation. The pitch-cycles that are known are referred to as the Prototype Waveforms.

PWI works extremely well for voiced segments, however, it is not applicable to unvoiced speech. Therefore, in step 508, the noise present in unvoiced frequency domain must be suppressed using the method of estimating SNR described above. Noise suppression at points 410*a* and 410*b* can be accomplished using PWI only or combining PWI with the method of estimating SNR described above. In so doing, WI represents speech with a series of evolving waveforms. For voiced speech, these waveforms are simply pitch-cycles. For unvoiced speech and background noise, the waveforms are of varying lengths and contain mostly noise-like signals.

In step 510, the synthesized periodic signals are combined within each sub-band 406. Then in step 512, a noise suppressed speech signal is generated from the synthesized periodic signals in each band 406. Therefore, noise suppression element 302 smoothes out spectrum 402, making it less noisy across all bands 406, which greatly improves the SNR for spectrum 402 across all bands 406.

In step 514, the noise suppressed speech signal is encoded, using CELP for example. In step 516, encoding parameters related to the noise suppressed speech signal are transmitted to a decoder, where, in step 508, they are decoded. Decoding of the parameters allows for synthesis of a noise reduced speech signal in the decoder.

Those skilled in the art will recognize that speech coding system 300 may be incorporated in a variety of voice communication systems. For example, speech coding system 300 is easily included in wireless communications systems, such as a cellular or PCS systems, regardless of the air interface or communications protocol used by the wireless communications system. In this case, transmission channel 306 is an RF transmission channel. Other embodiments that incorporate speech coding system 300 and a RF transmission channel 306 are cordless telephone systems and wireless local loops.

Figure 6:
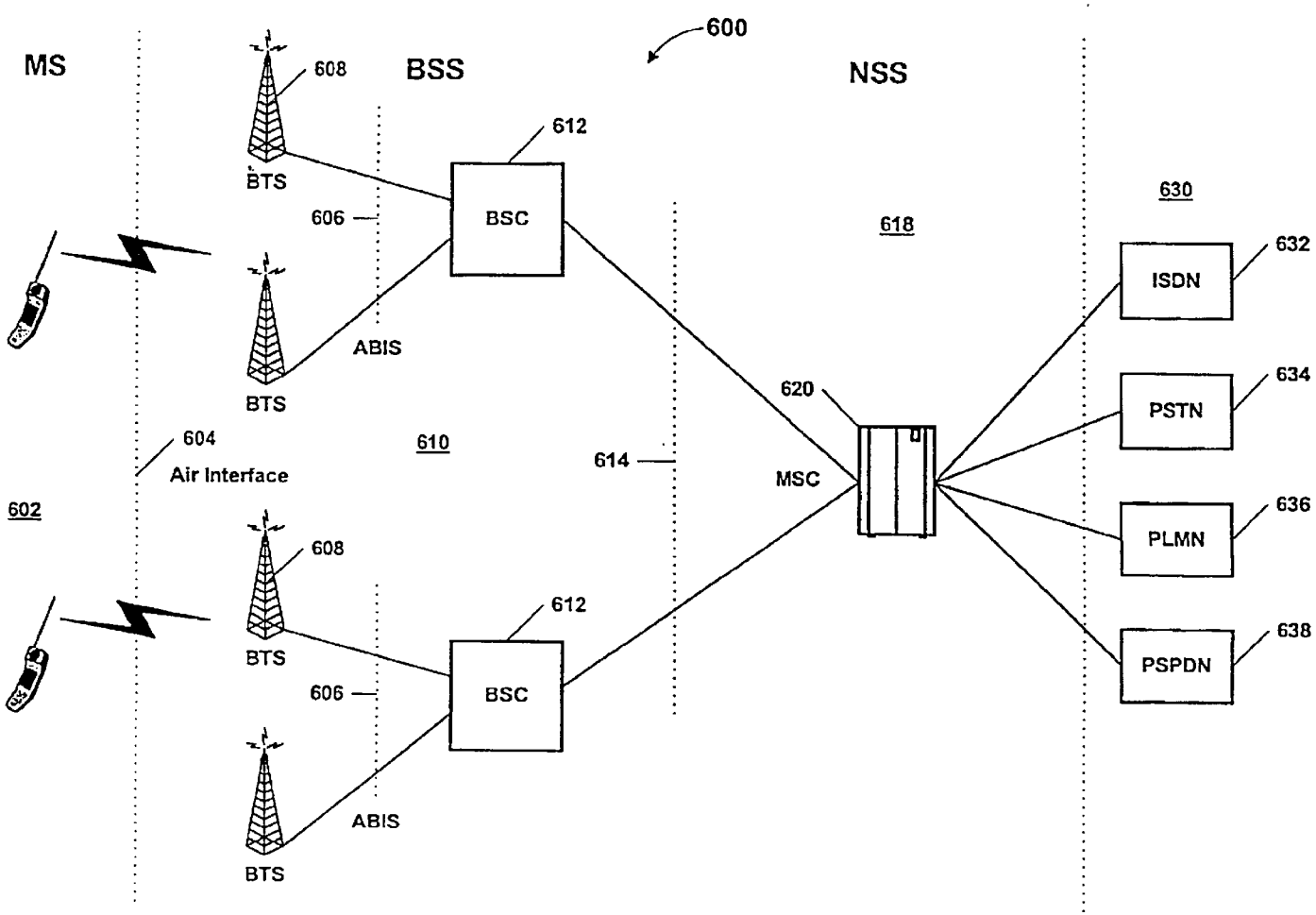
FIG. 6 is a block diagram illustrating an example wireless communication system.

The architecture of one implementation of a cellular network 600 is depicted in block form in FIG. 6. The network 600 is divided into four interconnected components or subsystems: A Mobile Station (MS) 602, a Base Station Subsystem (BSS) 610, and a Network Switching Subsystem (NSS) 618. Generally, a MS 602 is the mobile equipment or phone carried by the user. And a BSS 610 interfaces with multiple MS's 602 to manage the radio transmission paths between the MS's 602 and NSS 618. In turn, the NSS 618 manages system-switching functions and facilitates communications with other network such as the PSTN and the ISDN.

MS's 602 communicate with the BSS 610 across a standardized radio air interface 604. BSS 610 is comprised of multiple base transceiver stations (BTS) 608 and base station controllers (BSC) 612. BTS 608 is usually in the center of a cell and consists of one or more radio transceivers with an antenna. It establishes radio links and handles radio communications over the air interface with MS 602 within the cell. The transmitting power of the transceiver defines the size of the cell. Each BSC 612 manages BTS's 608. The total number of transceivers per a particular controller could be in the hundreds. The transceiver-controller communication is over a standardized "Abis" interface 606. BSC 612 allocates and manages radio channels and controls handovers of calls between its transceivers.

BSC 612, in turn, communicates with NSS 618 over a standardized interface 614. A Mobile Switching Center (MSC) 620 is the primary component of the NSS 618. MSC 620 manages communications between MS's 602 and between MS's 602 and public networks 630. Examples of public networks 630 that the mobile switching center may interface with include Integrated Services Digital Network (ISDN) 632, Public Switched Telephone Network (PSTN) 634, Public Land Mobile Network (PLMN) 636 and Packet Switched Public Data Network (PSPDN) 638.

Cellular networks, like the example depicted in FIG. 6, provide mobile communications ability for wide areas of coverage. The networks essentially replace the traditional wired networks for users in large areas. But wireless technology can also be used to replace smaller portions of the traditional wired network.

Each home or office in the industrialized world is equipped with at least one phone line. Each line represents a connection to the larger telecommunications network. This final connection is termed the local loop and expenditures on this portion of the telephone network account for nearly half of total expenditures. Wireless technology can greatly reduce the cost of installing this portion of the network in remote rural areas historically lacking telephone service, in existing networks striving to keep up with demand, and in emerging economies trying to develop their telecommunications infrastructure.

Figure 7:
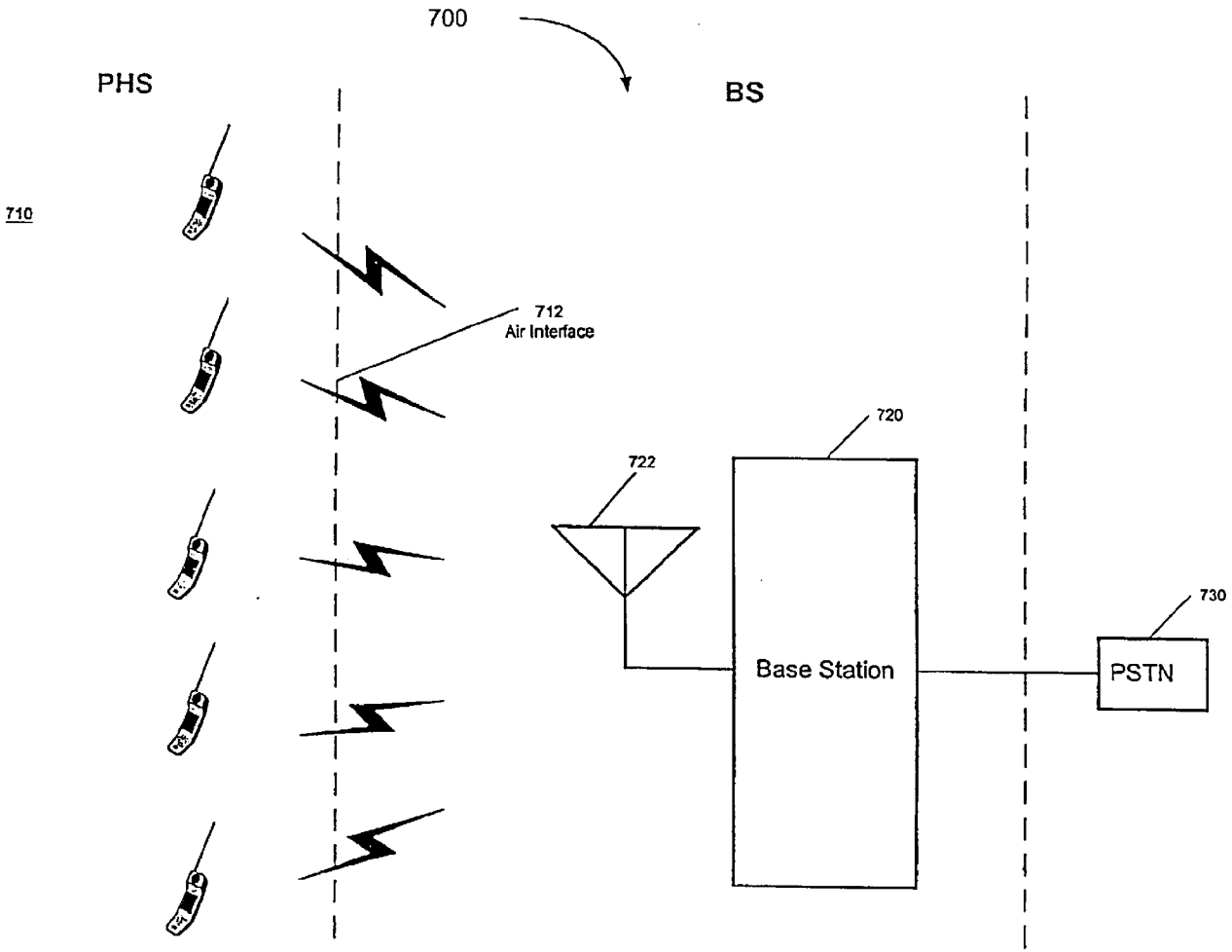
FIG. 7 is a block diagram illustrating one example embodiment of a wireless local loop.

FIG. 7 illustrates the architecture of one implementation of a wireless local loop (WLL). It consists of a cluster of Portable Handsets (PHS) 710, and a base station 720 equipped with an antenna 722. Traditionally, the handsets would be fixed landlines connected to the network via a twisted pair of copper. Recent developments have allowed the use of more advanced technology such as fiber optic. The advanced technology results in higher quality voice transmission and is more suited to the integration of voice and data in telecommunications. But all of these technologies require the installation of cables or wires that are costly to install and once installed are not easily repositioned.

Fortunately, the wired connection can be replaced as shown in FIG. 7. In FIG. 7, a network 730 is connected to a centrally located base station 720. The base station could be at the center of an office building, for example. The base station then interfaces with PHS 710 via an air interface 712. Thus, the costly installation of wires or cables is eliminated and flexible use and expansion of PHS 710 is possible.

Figure 8:
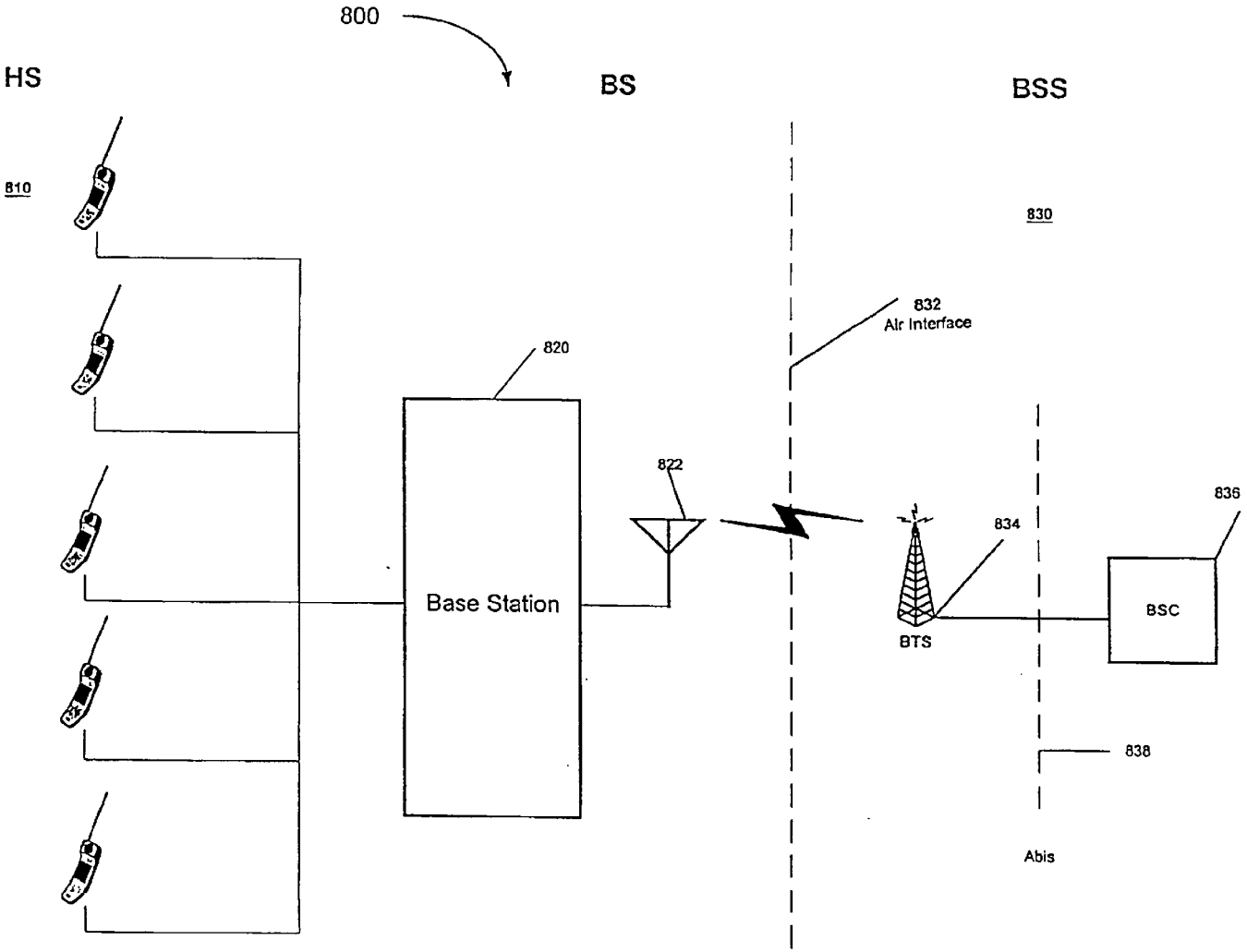
FIG. 8 is a block diagram illustrating a second example embodiment of a wireless local loop.

FIG. 8 illustrates an alternative implementation 800 of WLL. This implementation could be utilized in areas where cellular coverage is good. It consists of handsets (HS) 810 and a base station 820. In this implementation HS's 810 are wired to base station 820 and base station 820 interfaces via an antenna 822 over an air interface 832 to a cellular network 830. In this implementation, the cellular network would be the same as illustrated in FIG. 6, with base station 820 taking the place of the mobile handsets in that example. This implementation still requires the installation of costly wiring in the local loop. But it may be suitable for remote areas or areas where access to the network is difficult.

Figure 9:
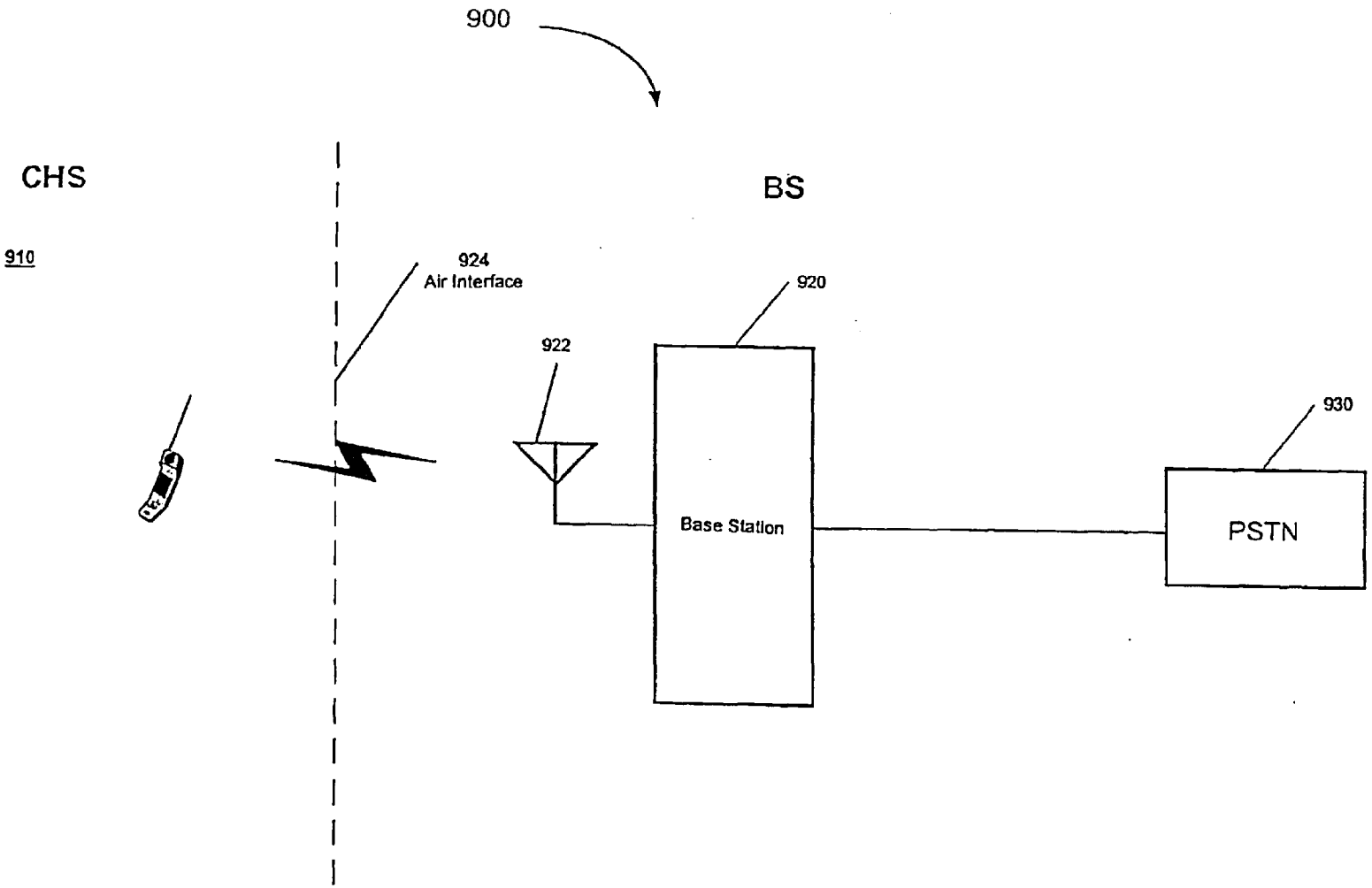
FIG. 9 is a block digram illustrating an example cordless phone system.

Another area in which wireless technology is aiding telecommunications is in the home where the traditional telephone handset is being replaced by the cordless phone system. A cordless phone system 900 implementation is illustrated in FIG. 9, and is, in many ways, a mini-version of the WLL systems described above. System 900 consists of a cordless telephone system base station 920 and a cordless handset 910. Base station 920 communicates with handset 910 over an air interface 924 via an antenna 922 and is connected through a wired connection to the network 930. Cordless handsets 910 in the home allow for untethered use of handset 910, enabling the user the freedom to move about as long as they stay in the range of base station 920.

Each of these system implementations have in common the use of radios to communicate voice information over an air interface. Originally, radios used in wireless communications used analog transmission schemes. In recent decades, however, various standards for digital transmission techniques have been developed. The digital standards have greatly increased the quality and capacity of the systems described above, and have allowed for higher quality voice reproduction.

In that regard, speech coding system 300 is easily incorporated into the radios of bases 608, 720, 820, and 920, and handsets 602, 710, and 910, within the systems 600, 700, 800, and 900, described above. Thus, the quality of voice reproduction in systems 600, 700, 800, and 900 will be improved even further due to the noise suppression provided by speech coding system 300.

Figure 10:
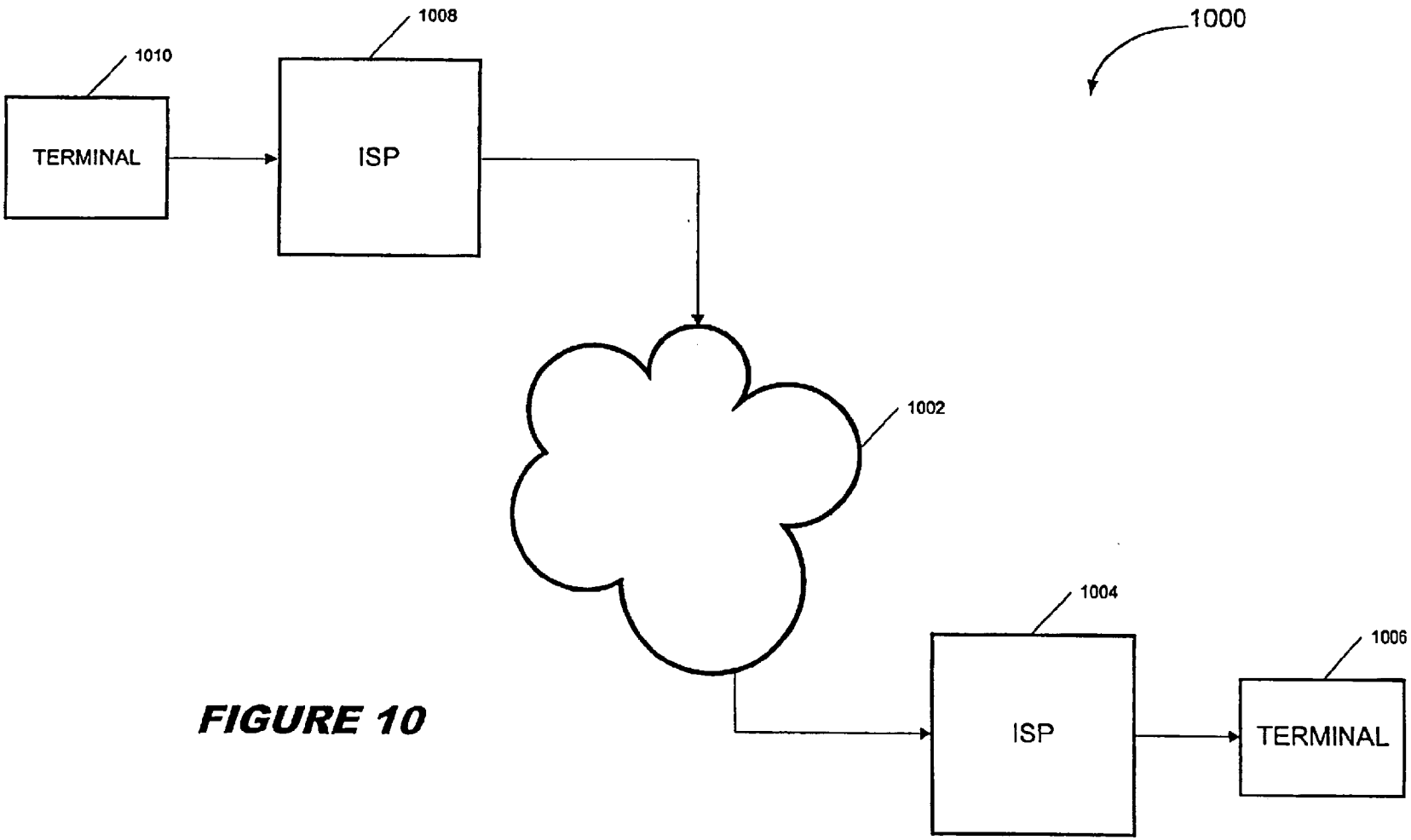
FIG. 10 is a block diagram illustrating an example system for transmitting voice over the Internet.

Additionally, voice over Internet is a growing field, seeing wider and wider implementation. A general system 1000 for implementing voice over Internet is illustrated in FIG. 10. Typically, voice traffic will pass from the Internet 1002 through an Internet Service Provider (ISP) 1004 to an end user. The end user will typically receive the voice traffic via a terminal 1006, such as a phone or computer. For example, in one embodiment, an Internet telephone call may be initiated by a phone terminal 1010, which will pass through one ISP 1008, then through the Internet 1002, and finally through a second ISP 1004 and to the end user at terminal 1006. Speech coding system 300 is integrated into a system such as 1000 as easily as it is integrated into a wireless communication system as discussed above. In the case of system 1000, the noisy speech signal ns(n) and/or the transmission channel 306 may be telephone line signals and channels, respectively. The media used for the transmission channel 306 can, for example, may be fiber optic, coaxial cable, or twisted pair.

Those skilled in the art will recognize that there are many systems that utilize speech coding systems to communicate voice speech information. Clearly the invention can be implemented within any such system that must deal with noisy speech signals. Therefore, the above sample systems are by way of example only and are not intended to limit the invention in anyway.

What is claimed:

1. A speech encoder for encoding a speech signal having a spectrum, said spectrum being divided into a plurality of sub-bands, said speech encoder comprising:

a background noise suppression element configured to pre-process said speech signal and to generate a background noise reduced speech signal; and a linear prediction (LP)-based synthesis-by-analysis coder coupled to said background noise suppression element and configured to apply an LP-based coding process to said background noise reduced speech signal, said LP-based synthesis-by-analysis coder including an error weighting filter for shaping a spectrum of an error signal;

wherein said background noise suppression element is further configured to perform a first background noise reduction operation to emphasize harmonic frequencies of said speech signal in each sub-band of said plurality of sub-bands and to reduce background noise between harmonic peaks of said harmonic frequencies to generate said background noise reduced speech signal;

wherein said background noise suppression element is further configured to determine whether said speech signal is a voiced signal or an unvoiced signal, and wherein said background noise suppression element performs said first background noise reduction operation if said speech signal is said voiced signal, and wherein said background noise suppression element performs a second background noise reduction operation if said speech signal is said unvoiced signal; and wherein said LP-based synthesis-by-analysis coder applies said LP-based coding process to said background noise reduced speech signal whether voiced signal or unvoiced signal.

2. The speech encoder of claim 1, wherein said background noise suppression element is further configured to smooth harmonic parameters at said harmonic peaks when performing said first background noise reduction operation.

3. The speech encoder of claim 1, wherein said background noise suppression element is further configured to use a harmonic modeling technique to emphasize said harmonic frequencies of said speech signal when performing said first background noise reduction operation.

4. The speech encoder of claim 3, wherein said harmonic modeling technique is PWI.

5. The speech encoder of claim 3, wherein said harmonic modeling technique is WI.

6. The speech encoder of claim 1, wherein said encoding element uses a technique from the group comprised of CELP, QCELP, MELP, and HE-LPC.

7. The speech encoder of claim 1, wherein said second background noise reduction operation includes estimating a signal-to-noise ratio (SNR) for each of said plurality of sub-bands, and reducing an energy of one or more said plurality of sub-bands determined to have a low SNR.

8. A speech coding system for coding a speech signal having a spectrum, said spectrum being divided into a plurality of sub-bands, said speech coding system comprising:

an encoder comprising:

a background noise suppression element configured to pre-process a speech signal and to generate a background noise reduced speech signal, and a linear prediction (LP)-based synthesis-by-analysis coder coupled to said background noise suppression element and configured to apply an LP-based coding process to said background noise reduced speech signal to generate an encoded background noise reduced speech signal, said LP-based synthesis-by-analysis coder including an error weighting filter for shaping a spectrum of an error signal, wherein said background noise suppression element is further configured to perform a first background noise reduction operation to emphasize harmonic frequencies of said speech signal in each sub-band of said plurality of sub-bands and to reduce background noise between harmonic peaks of said harmonic frequencies to generate said background noise reduced speech signal;

wherein said background noise suppression element is further configured to determine whether said speech signal is a voiced signal or an unvoiced signal, and wherein said background noise suppression element performs said first background noise reduction operation if said speech signal is said voiced signal, and wherein said background noise suppression element performs a second background noise reduction operation if said speech signal is said unvoiced signal; and wherein said LP-based synthesis-by-analysis coder applies said LP-based coding process to said background noise reduced speech signal whether voiced signal or unvoiced signal;

a decoder configured to decode said encoder background noise reduced speech signal to generate a synthesized background noise reduced speech signal; and a transmission channel for transmitting said encoded background noise reduced speech signal from said encoder to said decoder.

9. The speech coding system of claim 8, wherein said background noise suppression element is further configured to smooth harmonic parameters at said harmonic peaks when performing said first background noise reduction operation.

10. The speech coding system of claim 9, wherein said background noise suppression element is configured to use a harmonic modeling technique to emphasize said harmonic frequencies of said speech signal when performing said first background noise reduction operation.

11. The speech coding system of claim 8, wherein said encoder further generates speech parameters to encode said background noise reduces speech signal.

12. The speech coding system of claim 11, wherein said speech parameters include parameters that define an excitation signal and that define synthesis filter parameters.

13. The speech coding system of claim 8, wherein said transmission channel is a RF transmission channel or a telephone communication channel.

14. The speech coding system of claim 13, wherein said telephone communication channel comprises one of the communications medium from the group comprised of fiber optic, coaxial cable, and twisted pair.

15. The speech coding system of claim 8 in a system from a group comprised of a wireless communication network, a wireless local loop, a cordless phone system, and a voice over Internet system.

16. The speech coding system of claim 8, wherein said second background noise reduction operation includes estimating a signal-to-noise ratio (SNR) for each of said plurality of sub-bands, and reducing an energy of one or more said plurality of sub-bands determined to have a low SNR.

17. A method for reducing background noise in a speech signal prior to encoding said speech signal, said speech signal having a spectrum, said spectrum being divided into a plurality of sub-bands, said method comprising:

receiving said speech signal;

determining whether said speech signal is a voiced signal or an unvoiced signal; and if said determining determines that said speech signal is said voiced signal, applying a first noise reduction operation including:

emphasizing harmonic frequencies of said speech signal in each sub-band of said plurality of sub-bands; and reducing background noise between harmonic peaks of said harmonic frequencies to generate a background noise reduced speech signal; and if said determining determines that said speech signal is said unvoiced signal, applying a second noise reduction operation;

encoding said background noise reduced speech signal using a linear prediction (LP)-based synthesis-by-analysis coder whether said speech signal is said voiced signal or said unvoiced signal, wherein said LP-based synthesis-by-analysis coder includes an error weighting filter for shaping a spectrum of an error signal.

18. The method of claim 17, further comprising smoothing harmonic parameters at said harmonic peaks for said first noise reduction operation.

19. The method of claim 17, wherein said emphasizing said harmonic frequencies of said speech signal further comprises applying a harmonic modeling technique for said first noise reduction operation.

20. The method of claim 17, wherein when applying said second noise reduction operation, said method further comprising:

estimating a signal-to-noise ratio (SNR) for each of said plurality of sub-bands; and reducing an energy of one or more said plurality of sub-bands determined to have a low SNR.

* * * * *